United States Patent [19]

Inglis et al.

[11] Patent Number: 4,644,455

[45] Date of Patent: Feb. 17, 1987

[54] VEHICLE LAMP ASSEMBLY

[75] Inventors: Peter J. Inglis, Halesowen; Nicholas W. Tysoe, Worcester, both of England

[73] Assignee: Britax Vega Limited, Droitwich, England

[21] Appl. No.: 682,437

[22] Filed: Dec. 17, 1984

[30] Foreign Application Priority Data

Dec. 20, 1983 [GB] United Kingdom ..... 8333924

[51] Int. Cl.[4] ..... F21V 7/00

[52] U.S. Cl. ..... 362/309; 362/331; 362/339

[58] Field of Search ..... 362/307, 308, 309, 311, 362/327, 328, 331, 299, 300, 348, 349, 351, 361, 337, 339, 340, 244, 245, 246

[56] References Cited

U.S. PATENT DOCUMENTS

| | | | |
|---|---|---|---|
| 1,454,671 | 5/1923 | Dunlea | 362/327 |
| 2,341,822 | 2/1944 | Seal | 362/208 |
| 2,813,971 | 11/1957 | Pickett | 362/327 |
| 3,259,776 | 7/1966 | Wallace | 362/307 |
| 4,153,928 | 5/1979 | Speedy . | |
| 4,158,222 | 6/1979 | Cook | 362/311 |
| 4,241,388 | 12/1980 | Green | 362/311 |
| 4,383,290 | 5/1983 | Binder et al. | 362/328 |
| 4,525,772 | 6/1985 | Peck | 362/331 |

FOREIGN PATENT DOCUMENTS

| | | |
|---|---|---|
| 74726 | 3/1983 | European Pat. Off. . |
| 2062472 | 12/1970 | Fed. Rep. of Germany . |
| 3130085 | 7/1981 | Fed. Rep. of Germany . |
| 2427549 | 5/1979 | France . |
| 2525322 | 4/1982 | France . |
| 2079919 | 6/1981 | United Kingdom . |

*Primary Examiner*—Charles J. Myhre
*Assistant Examiner*—David A. Okonsky
*Attorney, Agent, or Firm*—Hayes, Davis & Soloway

[57] ABSTRACT

A vehicle lamp assembly comprises a light source and a light transmitting member carrying a plurality of strips formed of a light absorbing material. Baffle elements, formed of transparent material and each having an opaque coating on one of its side faces, extend perpendicular to the surface of the light transmitting member towards the light source. Each baffle element is aligned with a respective one of the parallel strips. Lens means are arranged to concentrate light from the light source between adjacent strips and a color filter is located between the light source and the baffle elements.

7 Claims, 11 Drawing Figures

VEHICLE LAMP ASSEMBLY

This invention relates to vehicle lamp assemblies of the type in which the colour of the light to be produced by the lamp cannot readily be perceived when the lamp is not illuminated. This reduces the risk that, in bright sunlight for example, the lamp assembly may appear to be illuminated, when in fact it is not.

More specifically, the invention relates to a vehicle lamp assembly comprising a light source, a light transmitting member carrying a plurality of strips formed of a light absorbing material, baffle elements of light absorbing material extending perpendicular to the surface of the light transmitting member towards the light source, each baffle element being aligned with a respective one of the parallel strips and being thinner than its corresponding strip, lens means arranged to concentrate light from the light source between adjacent strips and a colour filter located between the light source and the baffle elements. Normally, the light-absorbing strips are oriented horizontally but the invention is not restricted to any particular orientation.

A vehicle lamp assembly of this type is disclosed in our Patent Specification EP-A-0074726. The purpose of providing the baffle elements is to intercept off-axis externally originating light, such as sunlight before it reaches the colour filter. However, it has been found that these baffles have the undesirable effect of reducing the perceived brightness of the lamp, when illuminated, when the observer is above or below the horizontal optical axis, for example as the vehicle passes over the crest of a hill. The present invention aims to overcome this disadvantage.

According to the invention, in a vehicle lamp assembly of the type described above, the baffles are formed of transparent material and each baffle has an opaque coating on one of its side faces.

The effect of the foregoing is that the edges of the baffles facing the light source are of minimal area and consequently provide minimum interference to the light emerging from the lens means before it has been concentrated so as to pass between the strips on the light transmitting member.

The lamp assembly is preferably provided with secondary lens means arranged to increase the horizontal spread of emitted light in the direction parallel to the length of the strips of light absorbing material. Patent Specification No. GB-A-1591013 discloses such secondary lens means formed on an outer light transmitting member, located on the opposite side of the strips of light-absorbing material to the light source. The result of this is that, when the lamp is not illuminated, the strips of light-absorbing material, which determine the appearance of the lamp under these conditions, present an overall milky or watery appearance rather than a sharply defined colour.

According to a preferred embodiment of the present invention, the secondary lens means, for increasing the distribution of light emitted by the lamp assembly in directions parallel to the lengths of the strips of light-absorbing material, are located between such strips and the light source. For convenience of manufacture, the secondary lens means may be combined in a single lens assembly with the primary lens means. Alternatively, they may be formed integrally with the light transmitting member, in which case the strips of light-absorbing material are formed on the opposite surface to that facing the light source.

Preferably both the primary and secondary lens means comprise cylindrical lens formations, those of the primary lens means having their axes parallel to the strips of light-absorbing material and those of the secondary lens means having their axes perpendicular to the strips of light-absorbing material. In lamp assemblies in accordance with the invention where the number of strips of light-absorbing material is a multiple of the number of baffle elements, the primary lens means may be provided with prism formations aligned with each of the baffle elements and arranged to direct light from the light source through gaps between adjacent strips of light-absorbing material other than the gaps closest to such baffle element, thereby increasing the distribution of emitted light in the direction perpendicular to the strips of light-absorbing material.

In order to further enhance the distribution of light in the direction parallel to the strips of light-absorbing material, some of the lens elements of the secondary lens means may have a smaller focal length than the remaining lens elements thereof. The ratio of intensity of off-axis illumination to on-access illumination can then be controlled by varying the ratio of the aggregate area of lens elements of shorter focal length to the aggregate area of lens element of longer focal length.

Embodiments of the invention will now be described, by way of example, with reference to the accompanying drawings in which.

Figure 1:
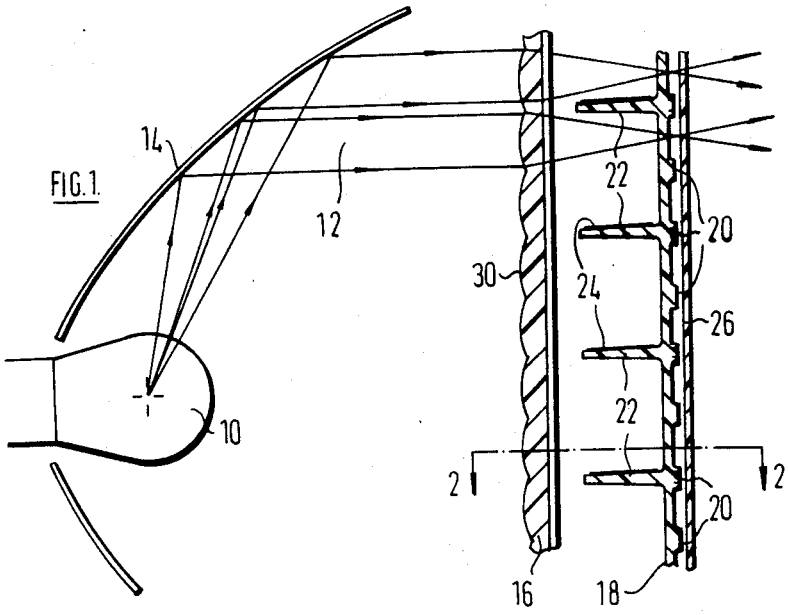
FIG. 1 is a schematic cross-sectional view, taken on a vertical plane, of a lamp assembly in accordance with the invention.

The lamp shown in FIG. 1 comprises a bulb 10, the light 12 from which is collimated by a parabolic reflector 14 so that a parallel beam is incident on a lens member 16 of transparent plastics material coloured in accordance with the required colour of the emitted light.

On the opposite side of the lens member 16 to the bulb 10, the lamp assembly has a light transmitting member 18, of clear plastics material, with an array of parallel strips 20 of light-absorbing material located on its outer surface. At least the outwardly facing side of the strips 20 is coloured in accordance with the required appearance of the lamp assembly when the bulb 10 is not illuminated. The light transmitting member 18 may be formed with raised zones aligned with each of the strips 20, as illustrated, in order to facilitate application of the strips 20 by a printing process. Opposite alternate strips 20, the light transmitting member 18 has a respective rib or baffle 22 extending parallel to the optical axis of the lamp assembly. The upper surface of each rib 22 has an opaque, preferably black, coating 24. Outside the light transmitting member 18, the lamp assembly has a parallel sided transparent outer cover member 26 which both provides the lamp assembly with a smooth outer surface and protects the strips 20 from abrasion.

The lens member 16 has cylindrical lens formations 30 on its inner surface oriented with their axes parallel to the strips 20 and each aligned with the gap between adjacent pairs of such strips. The foci of the lens element 30 are located slightly outside the plane of the strips 20 with the result that most of the light from the bulb 10 which is incident on the lens member 16 is directed between the strips 20.

On its outer surface, the lens member 16 has cylindrical lens formations 32 with their axes oriented perpendicular to the axes of the lens element 30 and with their foci outside the plane of the outer cover member 26. The lens elements 32 distribute the light emitted by the lamp assembly in the horizontal direction.

Figure 3:
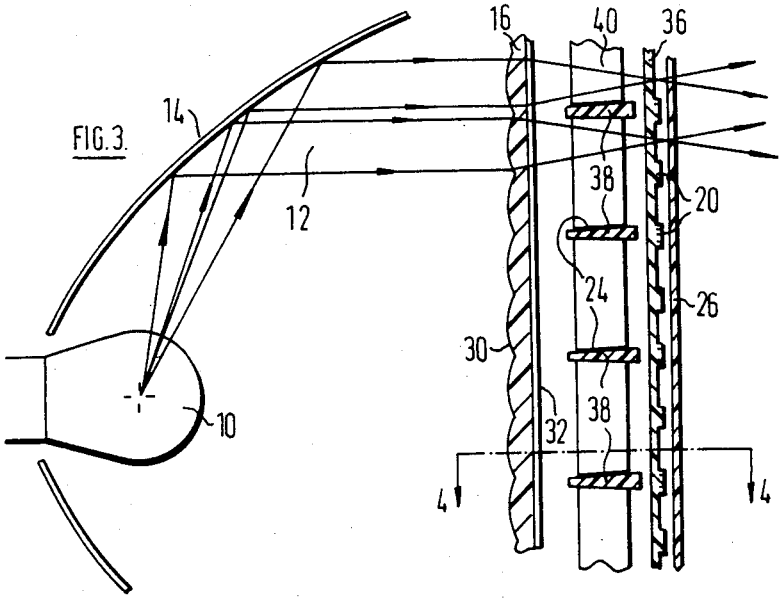
FIGS. 3 and 4 are cross-sectional views, corresponding to FIGS. 1 and 2 of another a lamp assembly in accordance with the invention.
Figure 2:
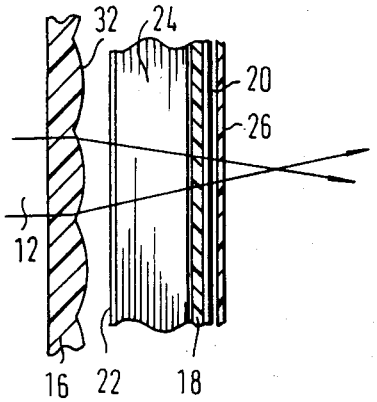
FIG. 2 is a cross-sectional view, taken on the line 2—2 in FIG. 1.
Figure 4:
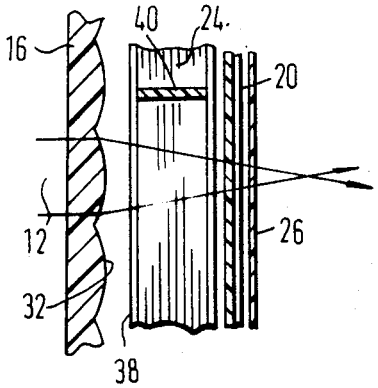

The embodiment illustrated in FIGS. 3 and 4 is generally similar to the embodiment illustrated in FIGS. 1 and 2. Corresponding components are denoted by the same reference numerals and will not be described again in detail. However, in place of the light transmitting member 18, the embodiment of FIGS. 3 and 4 has a light transmitting member 36 with the opaque strips 20 on its outer surface but with a flat inner surface. The ribs 22 are replaced by an array of transparent horizontal elements 38 which are supported on widely spaced vertically extending support members 40 and to which the opaque coatings 24 are applied. The members 38 and 40 may conveniently be moulded together as a single integral component. In all other respects, the embodiment of FIGS. 3 and 4 is identical with the embodiment of FIGS. 1 and 2.

Figure 6:
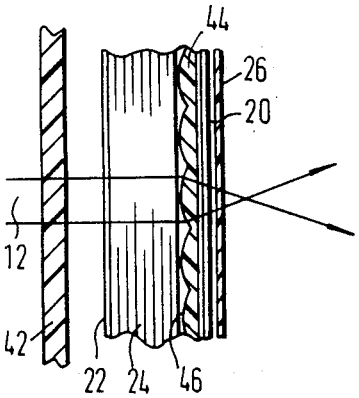
FIGS. 5 and 6 are cross-sectional views, corresponding to FIGS. 1 and 2 of a further embodiment of the invention.
Figure 5:
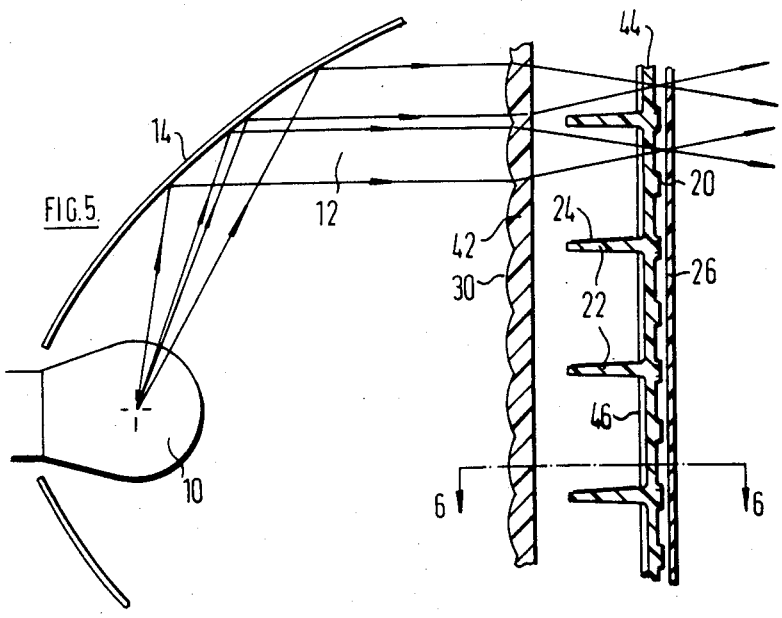

In the embodiment illustrated in FIGS. 5 and 6, the lens member 16 is replaced by a lens member 42 having the horizontally extending cylindrical lens elements 30 on its inner surface but a plane outer surface. As in FIG. 1, the light transmitting member 44 has the opaque strips 20 on its outer surface and the ribs 22 projecting from its inner surface. In addition, the inner surface of the light transmitting member 44 comprises cylindrical lens formations 46 located between the ribs 22 and oriented with their axes perpendicular to the axes of the lens formations 30. The lens formations 46 can have a shorter focal length than the lens formations 32 of FIG. 1, thereby giving a wider horizontal distribution, but the light transmitting member 44 is a more complex component than the light transmitting member 18 of FIG. 1.

Figure 8:
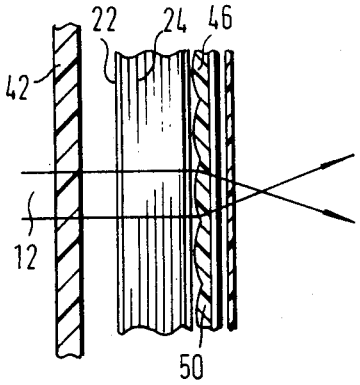
FIGS. 7 and 8 are cross-sectional views, similar to FIGS. 1 and 2 of a further embodiment of the invention.
Figure 7:
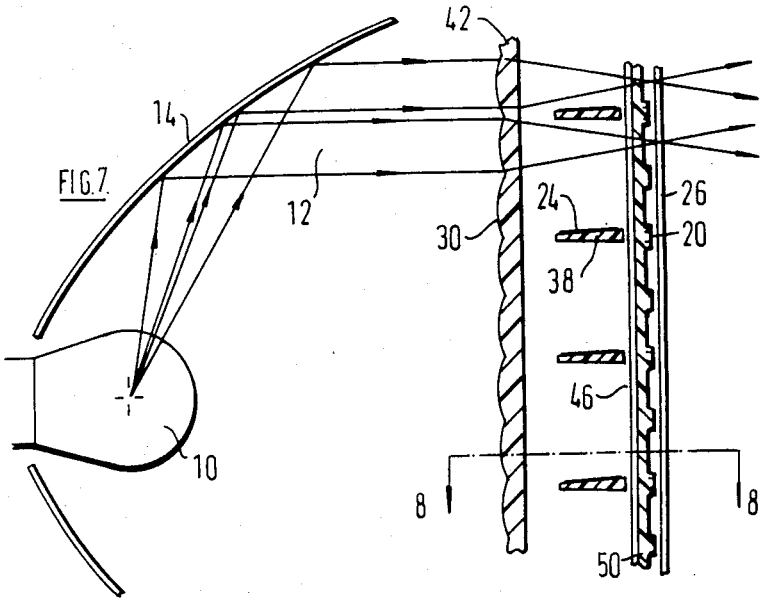

FIGS. 7 and 8 illustrate a further lamp assembly having a lens member 42 similar to that of FIGS. 5 and 6. However, its light transmitting member 50 is similar to the light transmitting member 44 of FIGS. 5 and 6 in that it has cylindrical lens formations 46 on its inner surface, but differs therefrom in that it does not have ribs 22. Instead it has an array of horizontal members similar to those of FIG. 3.

In either of the embodiments illustrated in FIGS. 5 to 8, the cylindrical lenses 46 may be replaced by so called "pillow optic" lens elements having curvature in both the horizontal and the vertical directions so as to enhance both the horizontal and vertical distribution of light. Since such lens elements are very close to the strips 20, the proportion of light transmitted is not adversely affected.

Figure 9:
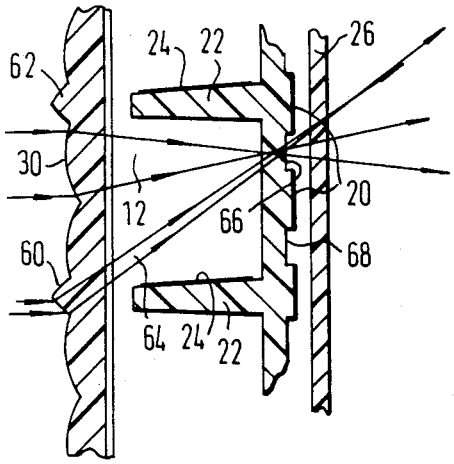
FIG. 9 is a fragmentary cross-sectional view, on an enlarged scale and taken on a vertical plane, of a modification to the embodiment illustrated in FIG. 1.

Turning now to FIG. 9, which illustrated a modification of the embodiment shown in FIG. 1, the proportion of the light incident on the lens member 16 which passes through the gaps between the strips 26 is increased by providing prism formations 60, 62 in alignment with each of the ribs 22. Light 64 incident on the lower surfaces of the prism formations 60 is deflected upwardly through the gap 66 between adjacent strips 26 next below the rib 22 which is aligned with the prism formation 62. Similarly, light incident on the upper surface of the prism element 62 would be directed through the gap 68 which is next above the rib 22 which is aligned with the prism formation 60. This additional light is inclined to the optical axis at a greater angle than most of the light from the main beam 12 collected by the lens formations 30. The result is, therefore, to enhance the vertical distribution of light.

Figure 11:
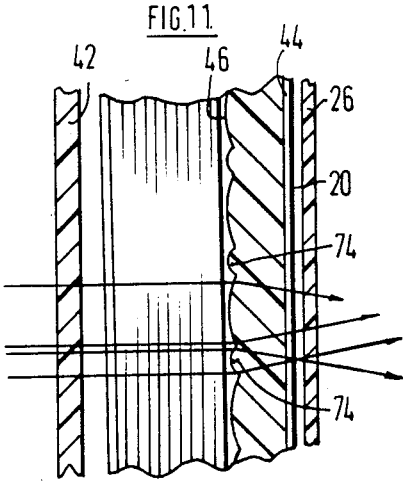
FIG. 11 is a cross-sectional view, similar to FIG. 10, of a modification of the embodiment illustrated in FIGS. 5 and 6.
Figure 10:
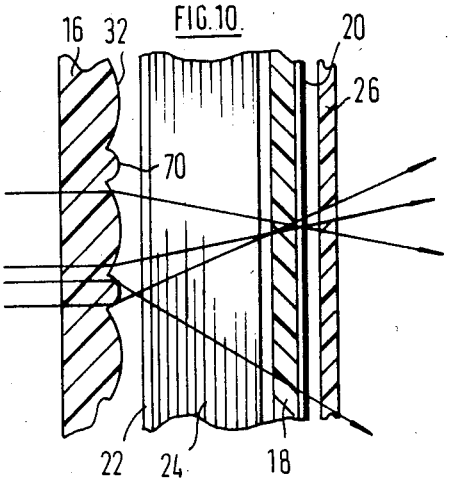
FIG. 10 is a fragmentary cross-sectional view, on an enlarged scale and taken on a horizontal plane, of another modification of the embodiment illustrated in FIG. 1.

Turning now to FIG. 10, the horizontal distribution of light from either of the embodiments illustrated in FIGS. 1 to 4 can be enhanced by providing lens formations 70 between each of the lens formations 32 on the outer surface of the lens elements 16, the lens formations 70 having a shorter focal length than the lens formations 32. Light incident on the lens formations 70 is therefore deflected over a wider angle than that incident on the lens formations 32. The ratio of the intensity of off-axis illumination to that on the optical axis can be controlled by varying the relative width of the lens formations 70 and the lens formations 32. As illustrated in FIG. 11, a similar effect can be achieved with the embodiments illustrated in FIGS. 5 to 8 by providing short focal length lens formations 74 between each of the lens formations 46 on the light transmitting member 44 of FIGS. 5 and 6 or the light transmitting member 50 of FIGS. 7 and 8.

We claim:

1. A vehicle lamp assembly, comprising a light source, a light transmitting member, a plurality of parallel strips formed of a light absorbing material on said light transmitting member, baffle elements extending perpendicular to the surface of the light transmitting member towards the light source, primary lens means arranged to concentrate light from the light source such that said concentrated light is directed between said parallel strips, secondary lens means arranged to increase the distribution of emitted light in the direction parallel to the length of the strips of light absorbing material and a color filter located between the light source and the baffle elements, each baffle element being formed of transparent material, having an opaque coating on one of its side faces and being aligned with a respective one of the parallel strips.

2. A lamp assembly according to claim 1, wherein the secondary lens means are located between the strips of light absorbing material and the light source.

3. A lamp assembly according to claim 2, wherein the secondary lens means are combined in a single lens assembly with the primary lens means.

4. A lamp assembly to claim 2, wherein the secondary lens means are formed integrally with the light transmitting member, the strips of light-absorbing material being formed on the opposite surface to that facing the light source.

5. A lamp assembly according to claim 1, wherein both the primary and secondary lens means comprise cylindrical lens formations, those of the primary lens means having their axes parallel to the strips of light-absorbing material and those of the secondary lens means having their axes perpendicular to the strips of light-absorbing material.

6. A lamp assembly according to claim 5, wherein the number of strips of light-absorbing material is a multiple of the number of baffle elements and the primary lens means is provided with prism formations aligned with each of the baffle elements and arranged to direct light from the light source through gaps between adjacent strips of light-absorbing material other than the gaps closest to such baffle element.

7. A lamp assembly according to claim 5, wherein some of the lens elements of the secondary lens means have a shorter focal length than the remaining lens elements thereof.

* * * * *